US008967400B1

(12) United States Patent
Mumford et al.

(10) Patent No.: US 8,967,400 B1
(45) Date of Patent: Mar. 3, 2015

(54) COSMETIC ORGANIZER AND DISPLAY ASSEMBLY

(76) Inventors: Jennifer Mumford, Simi Valley, CA (US); Shana Smith, Simi Valley, CA (US)

( * ) Notice: Subject to any disclaimer, the term of this patent is extended or adjusted under 35 U.S.C. 154(b) by 252 days.

(21) Appl. No.: 13/547,226

(22) Filed: Jul. 12, 2012

(51) Int. Cl.
*A47F 5/00* (2006.01)
*A47F 3/14* (2006.01)

(52) U.S. Cl.
USPC ..... 211/135; 211/128.1

(58) Field of Classification Search
CPC ..... A47F 5/112; A47F 5/114; A47F 5/116; A47F 5/118; A47F 5/0062; A47F 5/08; A47F 5/0807; A47F 3/14; A47F 3/142; A47F 2005/165
USPC ..... 211/126.1, 126.5, 126.16, 128.1, 130.1, 211/133.1, 132.1, 133.6, 135; 206/581, 206/559, 561, 562, 564, 566, 563; 132/294, 132/295, 296, 297, 314, 317; 229/103
See application file for complete search history.

(56) References Cited

U.S. PATENT DOCUMENTS

| | | | | | |
|---|---|---|---|---|---|
| 1,609,945 | A | * | 12/1926 | Hermani | 211/135 |
| 1,739,730 | A | * | 12/1929 | Orthwine | 211/128.1 |
| 1,873,557 | A | * | 8/1932 | Davis | 206/561 |
| 1,886,532 | A | * | 11/1932 | Davidson | 211/135 |
| 1,918,329 | A | * | 7/1933 | Gore | 211/135 |
| 1,987,439 | A | * | 1/1935 | Froehlig | 108/100 |
| 1,998,481 | A | * | 4/1935 | Yoder | 206/63.5 |
| 2,062,165 | A | * | 11/1936 | Davidson | 211/135 |
| 2,078,557 | A | * | 4/1937 | Bjorkman | 190/109 |
| 2,097,553 | A | * | 11/1937 | Gruenberg | 248/450 |
| 2,101,623 | A | * | 12/1937 | Morgan | 206/449 |
| 2,112,070 | A | * | 3/1938 | Coventry | 211/135 |
| 2,174,689 | A | * | 10/1939 | Cox et al. | 211/126.1 |
| 2,251,814 | A | * | 8/1941 | Yohns | 211/130.1 |
| 2,298,427 | A | * | 10/1942 | Slanhoff | 211/135 |
| 2,517,030 | A | * | 8/1950 | Ringler | 211/128.1 |
| 2,518,779 | A | * | 8/1950 | Hennessey | 206/564 |
| 2,886,917 | A | * | 5/1959 | Yates | 206/77.1 |
| 3,139,192 | A | * | 6/1964 | Maguire | 211/135 |
| 5,370,232 | A | | 12/1994 | Tiramani | |
| 5,375,734 | A | | 12/1994 | Tiramani | |
| D365,892 | S | | 1/1996 | Markham | |
| 5,941,255 | A | | 8/1999 | Chen | |
| 6,179,102 | B1 | | 1/2001 | Weber et al. | |
| 6,796,431 | B1 | | 9/2004 | Goldring | |
| 6,820,755 | B1 | | 11/2004 | Ranjit | |
| 7,591,382 | B2 | * | 9/2009 | Brock | 211/10 |
| 2002/0096185 | A1 | | 7/2002 | Givens | |
| 2008/0017596 | A1 | | 1/2008 | Brock | |
| 2008/0179215 | A1 | | 7/2008 | Arvin | |

* cited by examiner

*Primary Examiner* — Patrick Hawn

(57) ABSTRACT

A cosmetic organizer and display assembly holds multiple cosmetic products in an organized manner that displays the cosmetics to facilitate selection of a desired product. The assembly includes a back panel, a bottom panel, and a front panel. The front panel extends upwardly from a forward edge of the bottom panel. A pair of side panels extends between the front panel and the back panel. A top panel extends between the side panels. The top panel has a top edge coupled to a front face of the back panel. The top panel extends downwardly and away from the front face of the back panel whereby a bottom face of the top panel forms an acute angle with respect to the front face of the back panel. A plurality of support panels is coupled to and extends between the side panels and outwardly from the top panel.

1 Claim, 3 Drawing Sheets

COSMETIC ORGANIZER AND DISPLAY ASSEMBLY

BACKGROUND OF THE DISCLOSURE

Field of the Disclosure

The disclosure relates to cosmetic organizer devices and more particularly pertains to a new cosmetic organizer device for holding multiple cosmetic products in an organized manner that also displays the cosmetics to facilitate selection of a desired product.

SUMMARY OF THE DISCLOSURE

An embodiment of the disclosure meets the needs presented above by generally comprising a back panel and a bottom panel coupled to and extending forwardly from a bottom edge of the back panel. A front panel extends upwardly from a forward edge of the bottom panel. Each of a pair of side panels is coupled to and extends between the front panel and the back panel. A top panel is coupled to and extends between the side panels. The top panel has a top edge coupled to a front face of the back panel. The top panel extends downwardly and away from the front face of the back panel whereby a bottom face of the top panel forms an acute angle with respect to the front face of the back panel. A plurality of support panels is coupled to and extends between the side panels and outwardly from the top panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
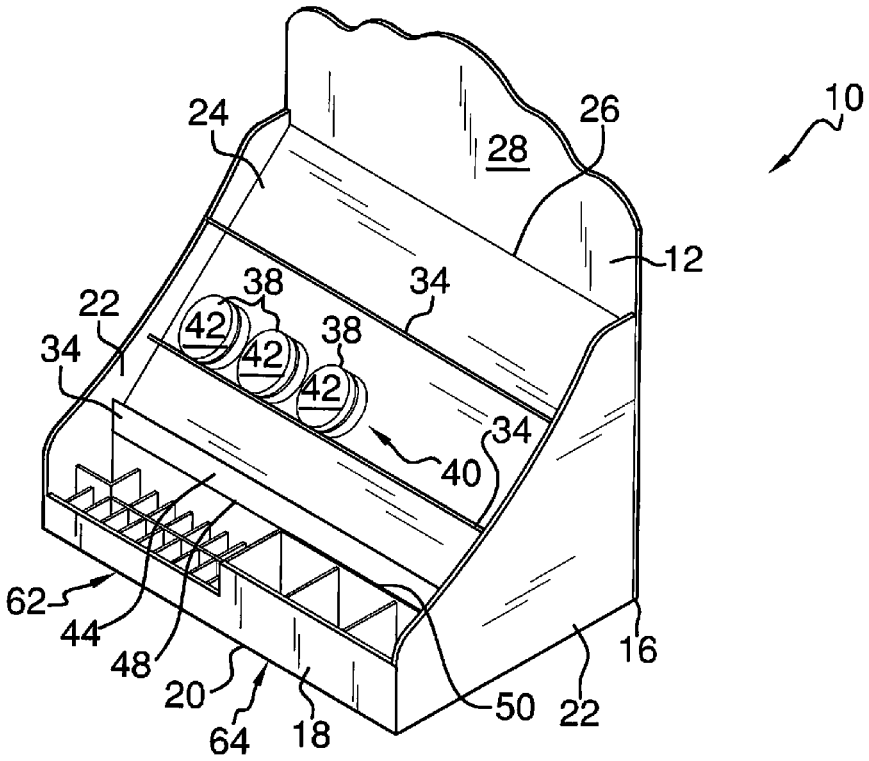
FIG. 1 is a top front side perspective view of a cosmetic organizer and display assembly according to an embodiment of the disclosure.
Figure 2:
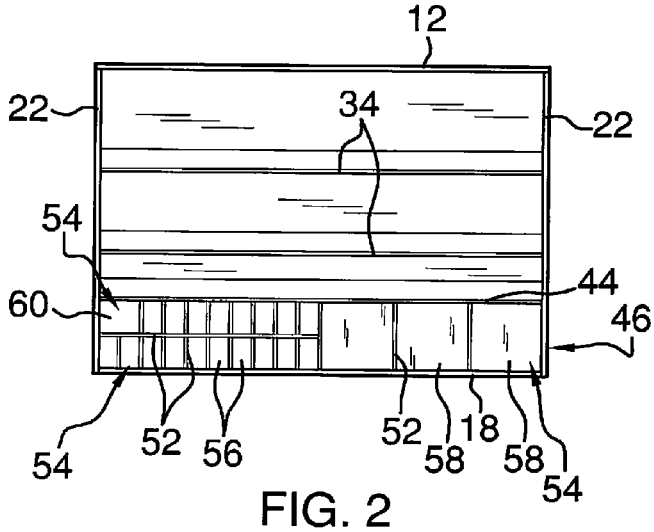
FIG. 2 is a top view of an embodiment of the disclosure.
Figure 3:
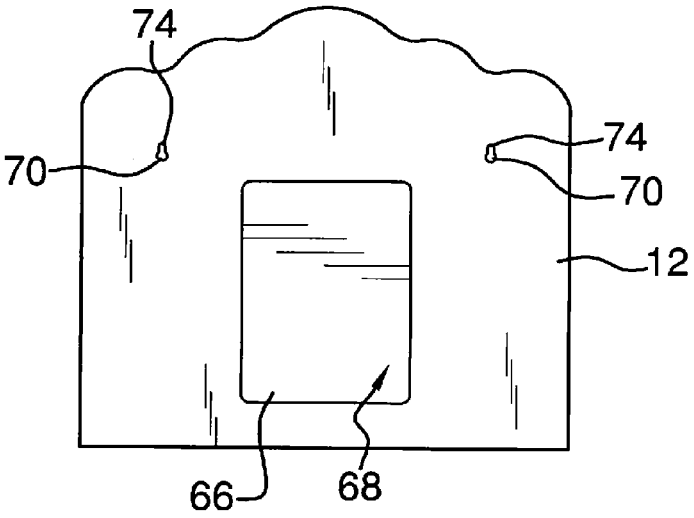
FIG. 3 is a back view of an embodiment of the disclosure.
Figure 4:
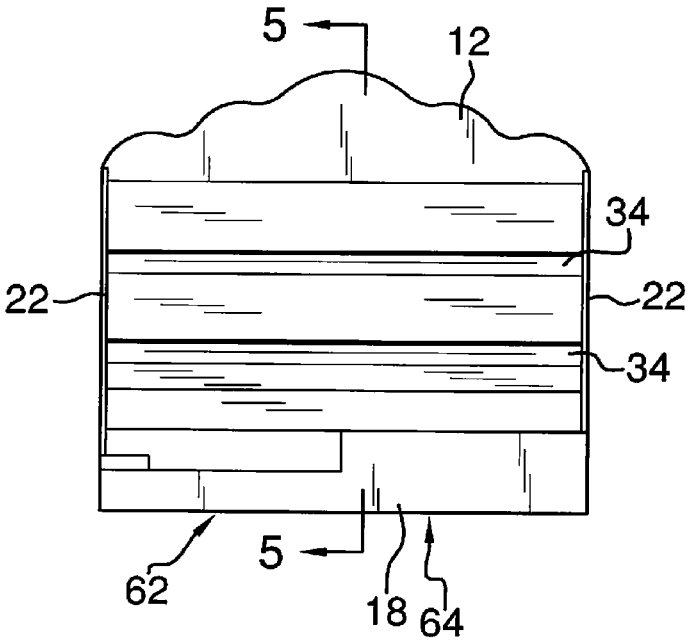
FIG. 4 is a front view of an embodiment of the disclosure.
Figure 5:
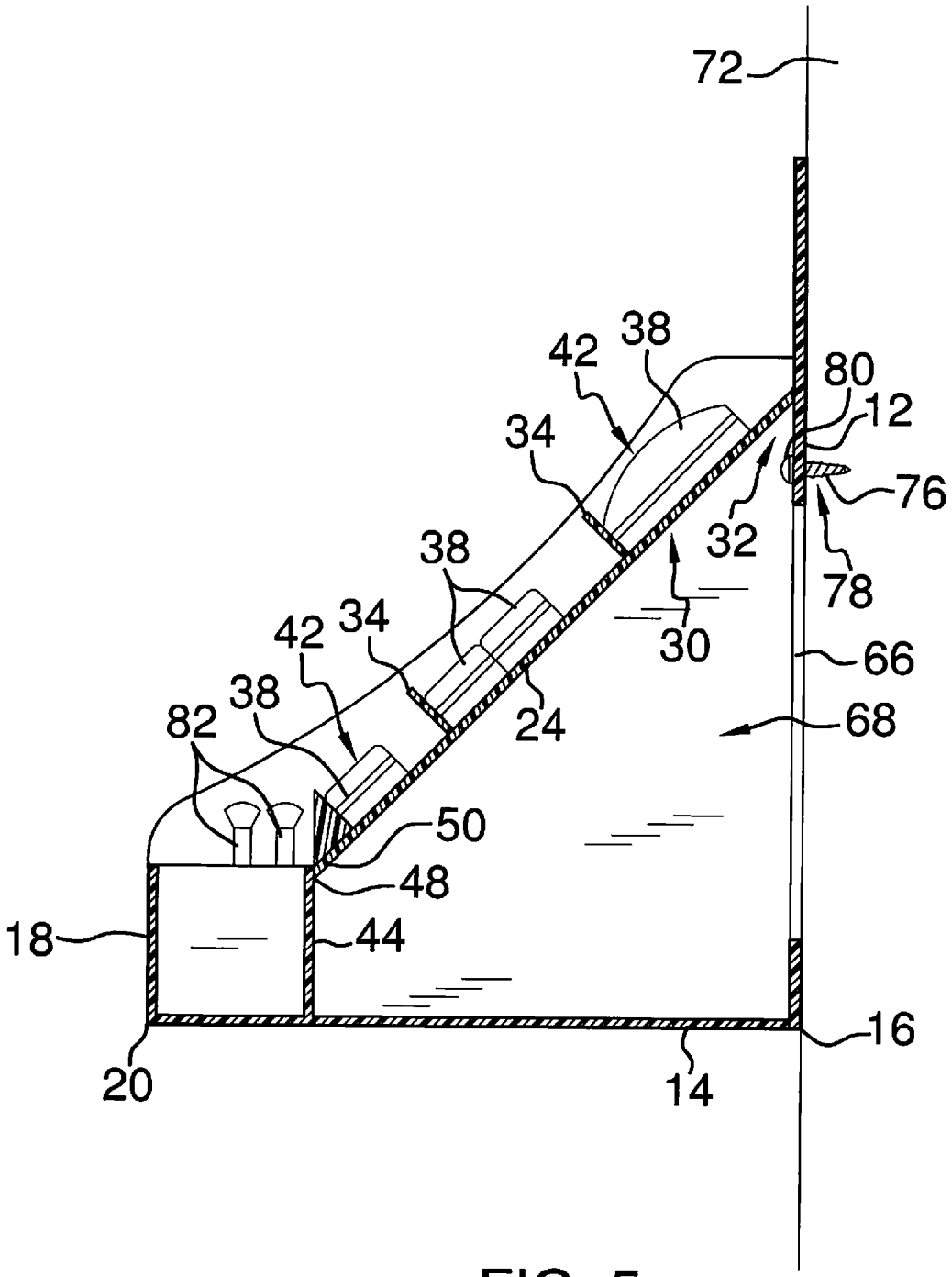
FIG. 5 is a cross-sectional view of an embodiment of the disclosure taken along line 5-5 of FIG. 4.

With reference now to the drawings, and in particular to FIGS. 1 through 5 hereof, a new cosmetic organizer device embodying the principles and concepts of an embodiment of the disclosure and generally designated by the reference numeral 10 will be described.

As best illustrated in FIGS. 1 through 5, the cosmetic organizer and display assembly 10 generally comprises a back panel 12. A bottom panel 14 is coupled to and extends forwardly from a bottom edge 16 of the back panel 12. A front panel 18 extends upwardly from a forward edge 20 of the bottom panel 14. A pair of side panels 22 is provided. Each side panel 22 is coupled to and extends between the front panel 18 and the back panel 12. A top panel 24 is coupled to and extends between the side panels 22. The top panel 24 may have a top edge 26 coupled to a front face 28 of the back panel 12. The top panel 24 extends downwardly and away from the front face 28 of the back panel 12 whereby a bottom face 30 of the top panel 24 forms an acute angle 32 with respect to the front face 28 of the back panel 12. A plurality of support panels 34 is coupled to and extends between the side panels 22. The support panels 34 extend outwardly from the top panel 24 and may be transverse to the top panel 24. The support panels 34 are positioned to support cosmetic holders 38 in rows 40 extending across the top panel 24. The angling of the top panel 24 relative to the back panel 12 displays a top surface 42 of the cosmetic holders 38.

A medial panel 44 may be coupled to and extend between the side panels 22. The medial panel 44 extends upwardly from the bottom panel 14 between the back panel 12 and the front panel 18. The medial panel 44 may have a top edge 48 coupled to a bottom edge 50 of the top panel 24. The medial panel 44 is in parallel spaced relationship to the front panel 18 defining a front section 46.

A plurality of interior walls 52 is coupled to and positioned in the front section 46 defining a plurality of front compartments 54 in the front section 46. The interior walls 52 are arranged to define a plurality of uniformly sized slots 56 and a plurality of uniformly sized chambers 58. The chambers 58 may have a depth measured transversely between said front panel 18 and said medial panel 44 and width measured between said side panels 22. The depth and width of each chamber 58 is greater than a depth and width of each of the slots 56. The interior walls 52 may be further arranged to define at least one segment 60 having a depth equal to a depth of the slots 56 and a width greater than a width of the slots 56 but less than a width of the chambers 58. The front panel 18 may have a first side 62 and a second side 64 wherein the first side 62 is aligned with said slots 56 and the second side 64 is aligned with the chambers 58. The first side 62 has a height less than a height of the second side 64.

An aperture 66 may extend through the back panel 12 to provide access to an interior 68 for hidden storage. A plurality of holes 70 extend through the back panel 12 whereby the back panel 12 is configured for being coupled to a vertical support surface 72. A plurality of slits 74 may be provided in the back panel 12 with each slit 74 extending from an associated one of the holes 70 in the back panel 12. Thus, each slit 74 is configured for receiving a shaft 76 of a screw 78 after a head 80 of the screw 78 is inserted through the associated hole 70.

In use, the assembly 10 is coupled to the support surface 72. Cosmetic holders 38 may be positioned for display and easy retrieval. The slots 56, chambers 58, and segment 60 may be used to organize and store other cosmetic products and applicators 82.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A cosmetic organizer and display assembly comprising:

a back panel;

a bottom panel coupled to and extending forwardly from a bottom edge of said back panel;

a front panel extending upwardly from a forward edge of said bottom panel;

a pair of side panels, each said side panel being coupled to and extending between said front panel and said back panel;

a top panel coupled to and extending between said side panels, said top panel having a top edge coupled to a front face of said back panel, said top panel extending downwardly and away from said front face of said back panel whereby a bottom face of said top panel forms an acute angle with respect to said front face of said back panel;

a plurality of support panels coupled to and extending between said side panels, said support panels extending outwardly from said top panel;

a medial panel coupled to and extending between said side panels, said medial panel extending upwardly from said bottom panel between said back panel and said front panel, said medial panel being in parallel spaced relationship to said front panel defining a front section;

a plurality of interior walls coupled to and positioned in said front section defining a plurality of front compartments in said front section, said interior walls being arranged to define a plurality of uniformly sized slots and a plurality of uniformly sized chambers, said chambers having a depth and width each greater than a depth and width of said slots, said interior walls being arranged to define at least one segment having a depth equal to a depth of said slots and a width greater than a width of said slots;

an aperture extending through said back panel, said aperture allowing access to an interior of said assembly for hidden storage within said assembly between said bottom panel and said top panel, said aperture allowing access to an upper surface of said bottom panel, said interior being accessibly only by said aperture;

a plurality of holes extending through said back panel whereby said back panel is configured for being coupled to a support surface; and a plurality of slits in said back panel, each slit extending from an associated one of said holes in said back panel whereby each said slit is configured for receiving a shaft of a screw after a head of the screw is inserted through said associated hole.

* * * * *